US010080260B2

(12) United States Patent
Shin

(10) Patent No.: US 10,080,260 B2
(45) Date of Patent: Sep. 18, 2018

(54) FINE HEATING WIRE AND HEATING UNIT USING THE SAME

(71) Applicant: NEWZIRO CO., LTD., Bucheon-si, Gyeonggi-do (KR)

(72) Inventor: Bongchel Shin, Bucheon-si (KR)

(73) Assignee: NEWZIRO CO., LTD., Bucheon-si (KR)

( * ) Notice: Subject to any disclaimer, the term of this patent is extended or adjusted under 35 U.S.C. 154(b) by 373 days.

(21) Appl. No.: 14/421,148

(22) PCT Filed: May 15, 2013

(86) PCT No.: PCT/KR2013/004321
§ 371 (c)(1),
(2) Date: Feb. 12, 2015

(87) PCT Pub. No.: WO2014/027739
PCT Pub. Date: Feb. 20, 2014

(65) Prior Publication Data

US 2015/0223290 A1 Aug. 6, 2015

(30) Foreign Application Priority Data

Aug. 16, 2012 (KR) ..... 10-2012-0089701

(51) Int. Cl.
*H05B 3/34* (2006.01)
*A41D 19/015* (2006.01)
(Continued)

(52) U.S. Cl.
CPC ..... *H05B 3/347* (2013.01); *A41B 11/00* (2013.01); *A41D 13/0051* (2013.01);
(Continued)

(58) Field of Classification Search
CPC ..... H05B 3/347; H05B 2203/015; H05B 2203/036; H05B 2203/003; A41D 19/01535; A41D 13/0051; A41B 11/00
(Continued)

(56) References Cited

U.S. PATENT DOCUMENTS 2,329,766 A * 9/1943 Jacobsen ..... H05B 3/342 126/204
4,384,449 A * 5/1983 Byrnes, Sr. ..... A41D 19/01511 139/425 R
(Continued)

FOREIGN PATENT DOCUMENTS

JP 08227616 A * 9/1996
KR 10-0291322 B1 9/2001
(Continued)

OTHER PUBLICATIONS

Akinobu Ono; Electric Insulated Wire; Sep. 3, 1996; JPO; 4 pages.*

*Primary Examiner* — Dana Ross
*Assistant Examiner* — Kuangyue Chen
(74) *Attorney, Agent, or Firm* — Im IP Law; C. Andrew Im

(57) ABSTRACT

A fine heating wire having a small diameter and applicable to various products. The fine heating wire is bendable, densely installed, and has high thermal efficiency. It includes a core formed with synthetic fiber material and a coil spirally wound around the outer portion of the core. The core connects one or more pairs of polyaramid fiber units. Each unit is formed by braiding dozens to hundreds of fine polyaramid fiber strands to maintain the diameter within 200-600 denier. The coil is formed of copper or copper alloy to withstand temperature rising up to 60° within five minutes when 3.7-12V power is supplied to maintain a resistance per unit length value equal to or greater than 0.5 Ω/m. The diameter of the fine heating wire is minimized to be installed
(Continued)

inside a slim fiber, and is bendable and densely installed to be applied to products, such as gloves and socks.

6 Claims, 6 Drawing Sheets

(51) Int. Cl.
*A41B 11/00* (2006.01)
*A41D 13/005* (2006.01)

(52) U.S. Cl.
CPC .. *A41D 19/01535* (2013.01); *H05B 2203/003* (2013.01); *H05B 2203/015* (2013.01); *H05B 2203/036* (2013.01)

(58) Field of Classification Search
USPC ..... 219/211, 539, 549
See application file for complete search history.

(56) References Cited

U.S. PATENT DOCUMENTS 5,979,081 A * 11/1999 Vaz ..... A43B 3/0026 36/107
6,279,305 B1 * 8/2001 Hummel ..... A41D 19/01511 57/210
2009/0057290 A1 * 3/2009 Williams ..... H05B 3/342 219/211

FOREIGN PATENT DOCUMENTS

KR 10-20100119703 A 11/2010
KR 20100119703 A * 11/2010
KR 10-20110027172 A 3/2011
KR 20110027172 A * 3/2011
KR 10-2011-0053863 A 5/2011
KR 10-20120005284 A 1/2012
KR 20120005284 A * 1/2012

* cited by examiner

FINE HEATING WIRE AND HEATING UNIT USING THE SAME

RELATED APPLICATIONS

This application is a § 371 application from PCT/KR2013/004321 filed May 15, 2013, which claims priority from Korean Patent Application No. 10-2012-0089701 filed Aug. 16, 2012, each of which is herein incorporated by reference in its entirety.

BACKGROUND OF THE INVENTION

Field of the Invention

The present invention relates to a heating wire, and more specifically, to a fine heating wire capable of being applied to various miniature products by having a small diameter, being bendable, and being densely installed, and having high thermal efficiency, and a heating unit using the same.

Background of the Related Art

When a conventional heating wire (or a heating cable) is applied to subminiature products such as functional winter clothes, a foreign body sensation is felt by a user, the overall volume is increased, and dense arrangement is impossible due to the thickness (normally about 2.5 mm) of the heating wire.

Also, thermal efficiency per unit area of a heating unit having the conventional heating wire installed is extremely decreased due to the thick heating wire, and consumed electric power per unit length of the heating wire is increased to satisfy a required heating value, thereby increasing a danger of electric shock.

Further, when the heating unit having the conventional heating wire installed is bent, the heating wire is damaged, thereby causing problems such as electric leakage, short circuit, and contact failure.

To improve such problems, Korean patent publication number 10-2011-0053863 (Wearable heating pad using flexible heating unit) (hereinafter, the prior art) was suggested. However, the prior art formed a surface heating unit by conductive mesh and a flexible heating wire, thereby having uneven resistance distribution overall. While being bent, the prior art had a danger of short circuit of the heating unit due to contact resistance.

SUMMARY OF THE INVENTION

Accordingly, the present invention has been made in view of the above-mentioned problems occurring in the prior art, and it is an object of the present invention to provide a fine heating wire capable of being applied to various miniature products by having a small diameter, being bendable, and being densely installed, and having high thermal efficiency due to low electric power consumption, and a heating unit using the same.

To accomplish the above-mentioned object, according to the present invention, provided is a fine heating wire including a core formed of synthetic fiber material and a coil spirally wound around the outer portion of the core in predetermined intervals. The core connects again one or more pairs of poly aramid fiber units, each formed by braiding dozens to hundreds of fine poly aramid fiber strands, to maintain the diameter within 200-600 denier. The coil is formed of copper or copper alloy to have a temperature rising up to 60° C. within five minutes when electric power of 3.7-12V is supplied in order to maintain a resistance per unit length value equal to or greater than 0.5 Ω/m.

According to the present invention, preferably, a fine heating wire has high tensile force, braids and connects fine poly aramid fiber strands to form a core, and a coil having a small diameter is spirally wound around the outer portion of the core, thereby securing firm tensile force even with the small diameter, having high thermal efficiency by being densely installed in a predetermined area, being installed inside thin fiber or pad by the slim diameter, and being densely installed by a characteristic of being bendable, such that the fine heating wire is applied to miniature products such as gloves, socks, and the like.

DETAILED DESCRIPTION OF THE PREFERRED EMBODIMENTS

Hereinafter, an explanation on a fine heating wire according to preferred embodiments of the present invention will be in detail given with reference to the attached drawing.

Figure 1:
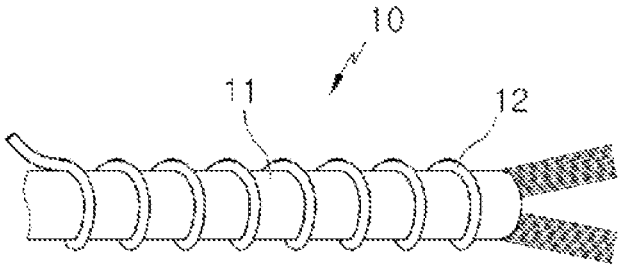
FIG. 1 is a drawing showing a fine heating wire according an embodiment of the present invention.

As in FIG. 1, the fine heating wire 10 according to the present invention includes an inner core 11 and a coil 12 spirally wound around the outer portion of the core 11.

Generally, in manufacturing a heating wire, tensile force is weakened if a diameter of the heating wire is small, causing many problems in use. The applicant realized a fine heating wire with excellent thermal efficiency after undergoing many trials and errors to apply material which can maintain high tensile force even with a small diameter.

The core 11 is formed by braiding and connecting poly aramid fiber strands having a fine diameter to increase tensile force. According to an embodiment of the present invention, dozens to hundreds of fine poly aramid fiber strands are braided, and one or more pairs of poly aramid fiber units are connected again to maintain the diameter of the core 11 within 200-600 denier.

Here, the length of the poly aramid fiber is not changed such as being shrunk even at a high temperature; the poly aramid fiber has excellent thermal resistance (approximately 427° C.) and cut resistance; and the poly aramid fiber also has tensile strength five times greater than iron while being light to improve product durability and lower progressive failure rate.

The denier is a unit for thickness of fiber and filament-fabric. 1 denier refers to thickness of 1 g weight having 9,000 m length. If the weight is two times greater and three times greater while 9,000 m length is fixed, the results are 2 denier and 3 denier. The thickness is greater as the number is greater.

Also, the coil 12 is spirally wound around the outer portion of the core 11, and is formed of copper or copper alloy (copper+nickel) to have a resistance per unit length value equal to or greater than 0.5 Ω/m to show a constant heating value.

The fine heating wire 10 is formed only of the core 11 and the coil 12, such that the diameter is minimized to be capable of being installed inside slim fiber or pad. The fine heating wire is bendable and can densely be installed to be capable of being applied to miniature products such as gloves, socks, and the like.

Figure 2:
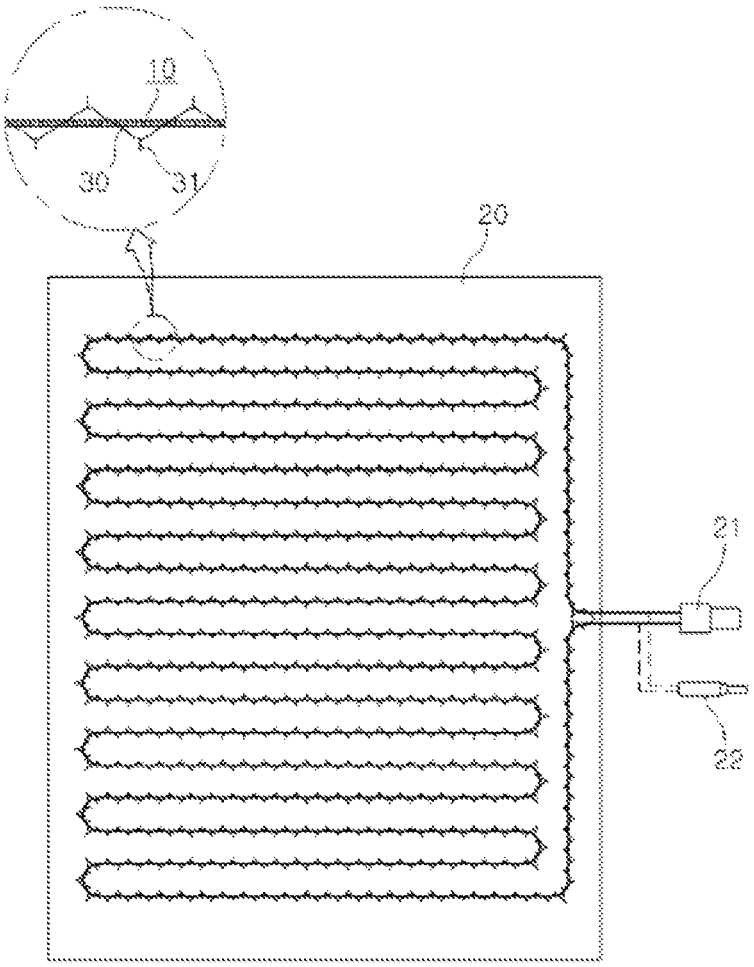
FIG. 2 is a first use state diagram of the fine heating wire according to an embodiment of the present invention.

For example, as in FIG. 2, the intervals among the fine heating wires are maximally narrowed to be installed in a zigzag shape by embroidering when being applied to slim fabric 20 to have the maximum thermal efficiency per unit area.

The fabric is applied to both woven goods (including synthetic fiber and natural fiber) and leather goods, and the fine heating wire according to the present invention is operated by low voltage to have a fixed maximum temperature, thereby not having the risk of fire at all.

Here, as depicted in the expanded figure, when fixing a fine heating wire 10 to the fabric 20, a first fixing wire 30 crossing both sides of the fine heating wire 10 in a zigzag shape by embroidering is fixed by embroidering, and the first fixing wire 30 is fixed again by a second fixing wire 31.

The fine heating wire 10 is simply fixed to the fabric 20 by the first fixing wire 30 and the second fixing wire 31 embroidered along the installed fine heating wire 10, thereby widely being used in heatproof clothes, cushions, backrests, bed sheets, and the like.

Meanwhile, the fine heating wire 10 has both ends connected to a USB connector 21 to which low electric power is applied in order to conveniently be used by being connected to a computer, an electronic device, or a USB power converter. The fine heating wire 10 has the both ends connected to a DC power connecting jack 22 in order to be used by being connected to a DC supplier or a normal AC/DC converter.

The fine heating wire 10 according to the present invention has the diameter considerably smaller (the resistance value higher) than a conventional product, thereby having the optimal thermal efficiency even under low voltage.

For example, the fine heating wire according to the present invention uses low applied power (3.7-12V) supplied from a USB connector of a normal computer or a small DC power supplier to have the temperature rising up to 60° C. within five minutes, and to maintain the temperature equal to or greater than 60° C. for at least eight hours when a battery (5V, 5400 mA) is used.

Figure 3:
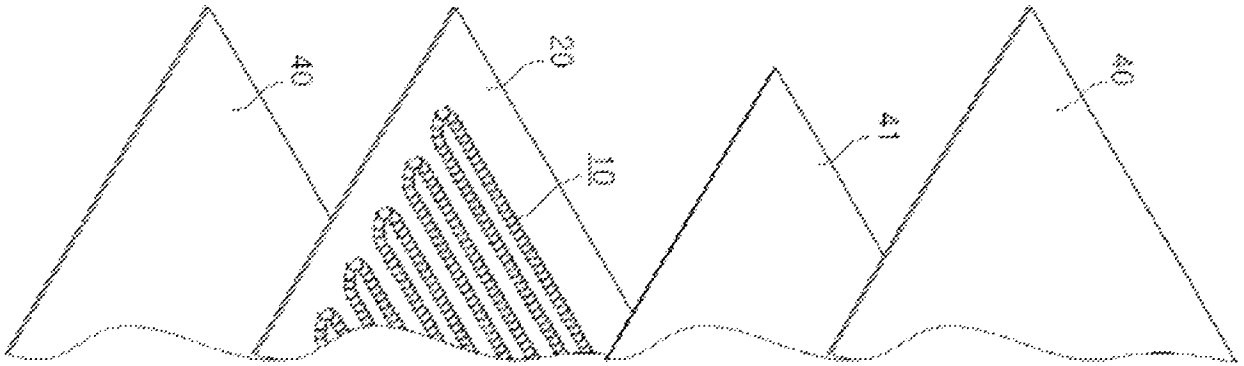
FIG. 3 is an exploded view showing a second use state of the fine heating wire according to an embodiment of the present invention.

As in FIG. 3, an outer cover 40 is coupled to upper and lower portions of the fabric 20 at which the fine heating wire 10 is installed to be used as cushions, blankets, and the like. A film 41, which is an insulator, may be inserted between the fine heating wire 10 and the outer cover 40 to prevent foreign substance from directly being transferred to the fine heating wire by damages to the outer cover.

Particularly, the film 41 is manufactured with special material to have various functions, such as releasing far infrared rays, anions, and the like, in accordance with a purpose of a product, such that additional effects may be added. For example, the film 41 is manufactured by mixing jade powder, charcoal powder, barley stone powder, and germanium powder to have an effect of releasing far infrared rays or anions.

Figure 4A:
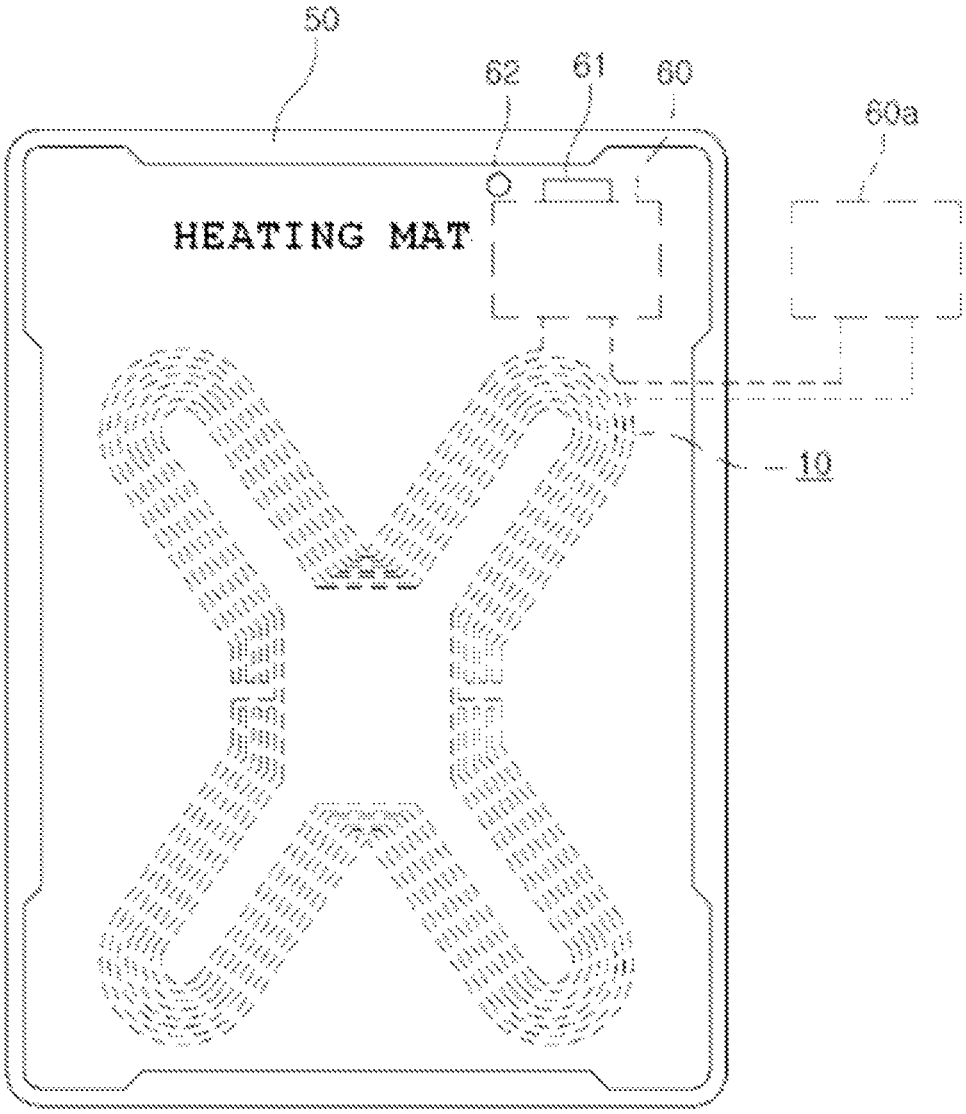
FIG. 4*a* is a third use state diagram of the fine heating wire according to an embodiment of the present invention.
Figure 4B:
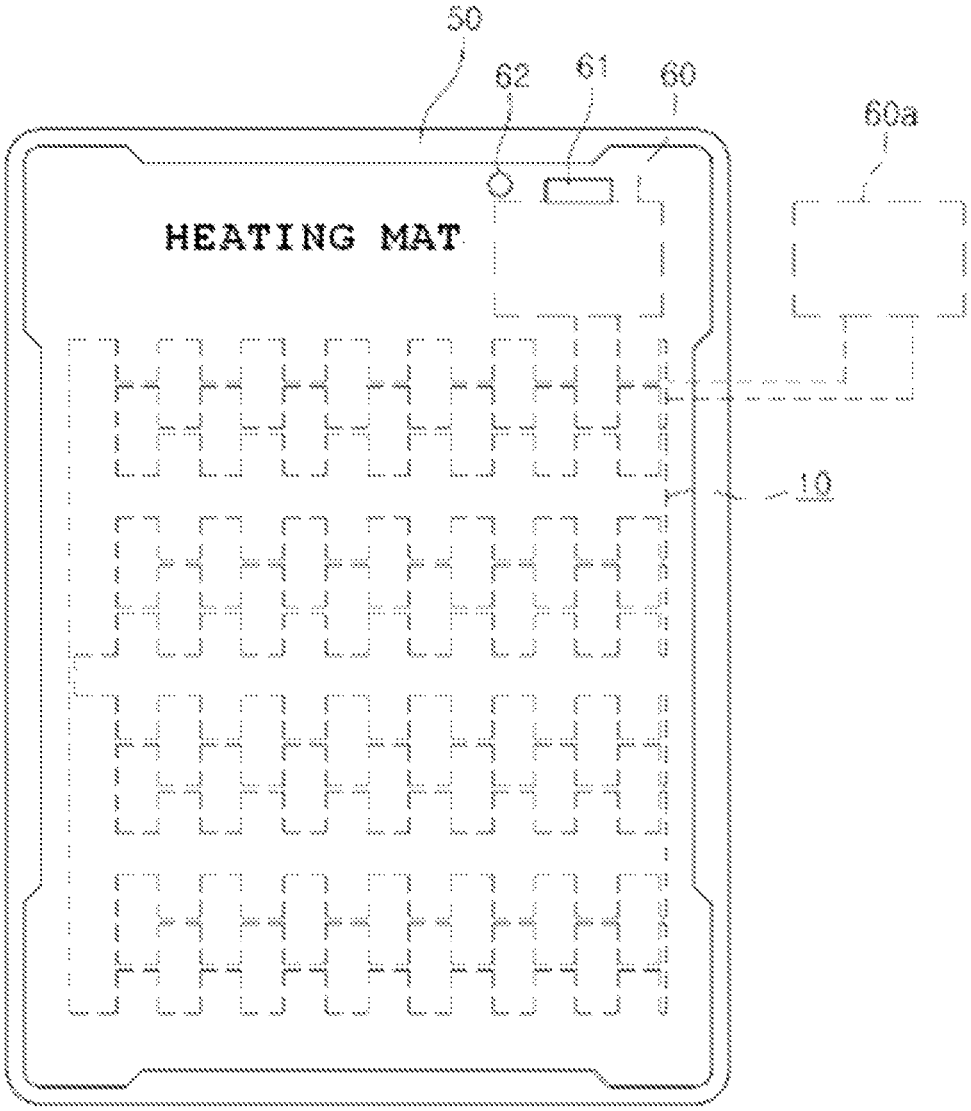
FIG. 4*b* is a fourth use state diagram of the fine heating wire according to an embodiment of the present invention.

Also, as depicted in FIGS. 4*a* and 4*b*, the fine heating wire 10 is formed in various patterns when being installed inside a mat 50 to control a heating value.

That is, the fine heating wire 10 may densely be installed as in FIG. 4*a* to generate great amount of heat in order to be used for outdoor in winter, while the fine heating wire 10 may also be installed in predetermined intervals as in FIG. 4*b* in order to be used for indoor.

The mat 50 receives power from inside or outside batteries 60 and 60*a* which may be charged or replaced, is able to manually control on/off of the power with an outside control switch 61, and has a temperature sensor 62 to automatically block the power if the temperature becomes equal to or greater than a predetermined temperature.

Figure 5:
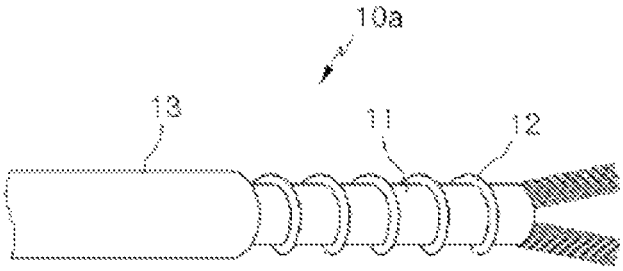
FIG. 5 is a drawing showing another embodiment of the present invention.
Figure 6:
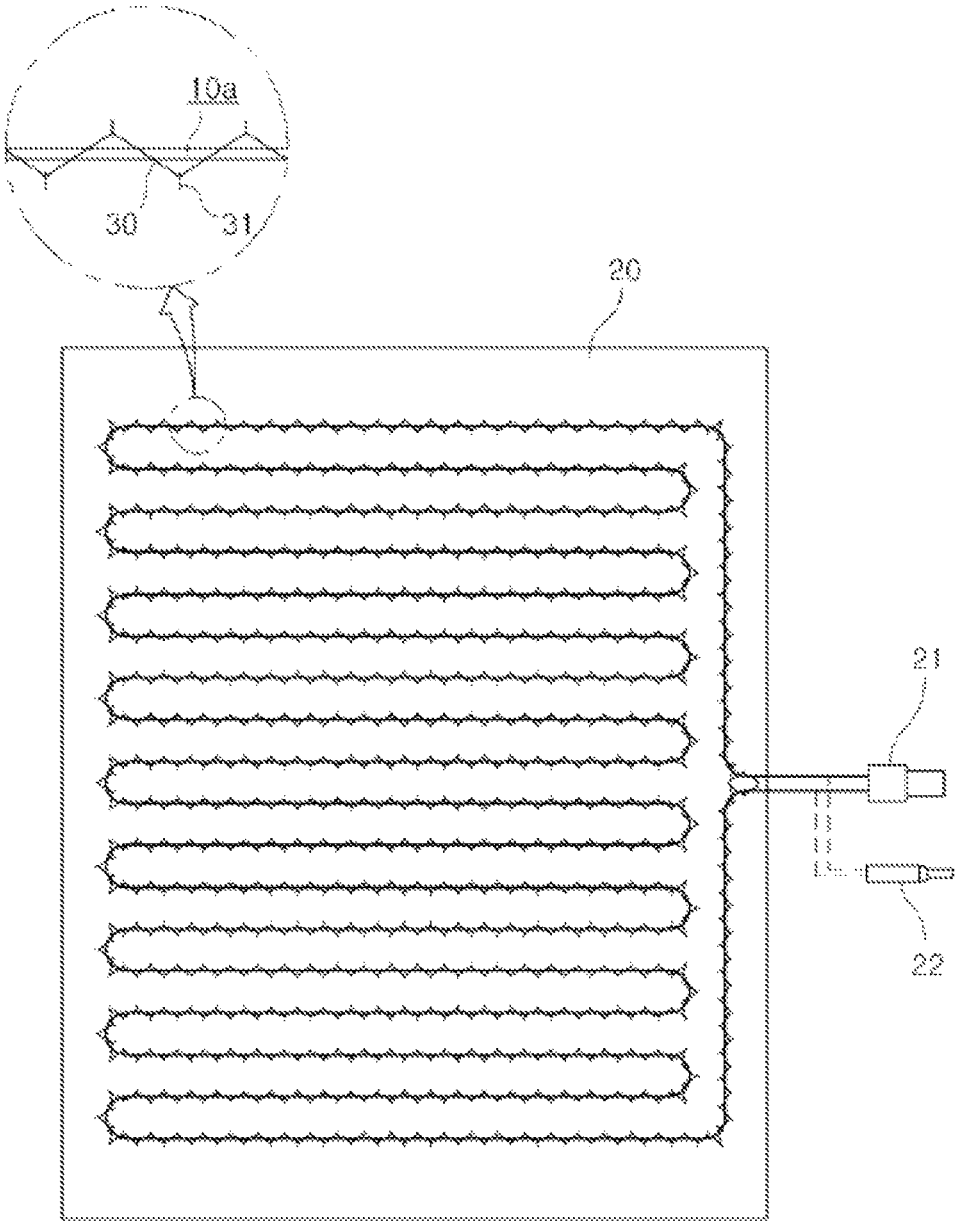
FIG. 6 is a use state diagram of the FIG. 5.

According to another embodiment of the present invention, a sheath 13, which is an insulator made of silicon, may be coated at the outer portion of the coil 12 as depicted in FIG. 5. Here, the fine heating wire 10*a* is fixed by the first fixing wire 30 and the second fixing wire 31 when being installed at the fabric 20, as in FIG. 6.

Here, the sheath 13 may be formed with normal wire materials including PVC, teflon, and the like, besides silicon. However, the fine heating wire should be able to maintain a small diameter overall.

Figure 7:
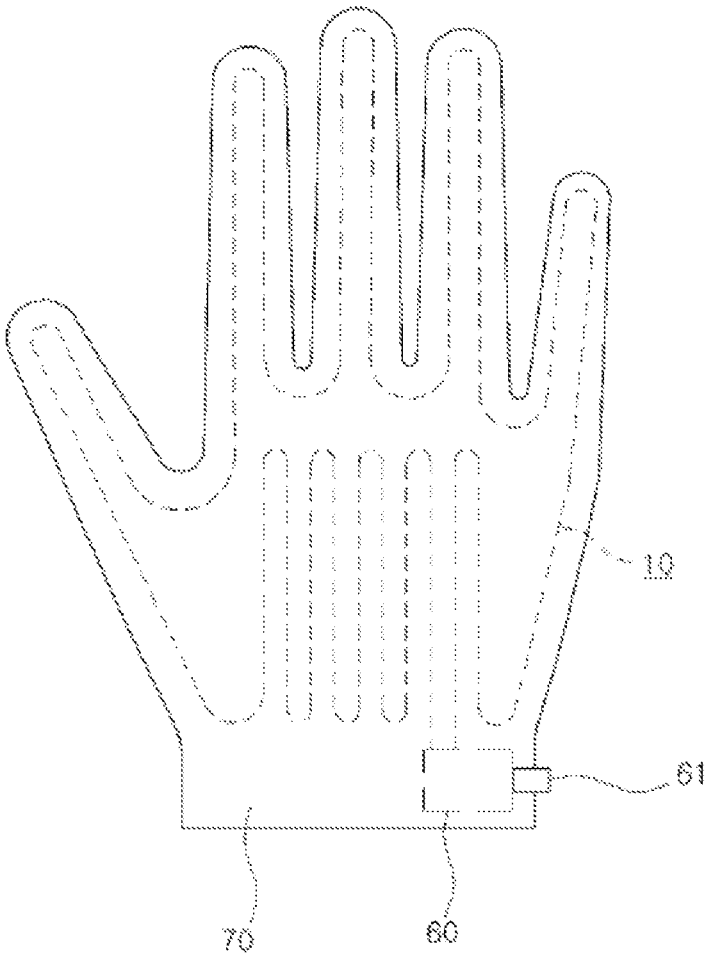
FIG. 7 is a fifth use state diagram of the fine heating wire according to an embodiment of the present invention.

Also, as in FIG. 7, the fine heating wire according to the present invention may densely be installed at products, e.g. gloves 70, which have to frequently be bent during use, thereby being more convenient, and is capable of controlling power supplied from the battery 60 by the control switch 61.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heating wire, comprising:

a core formed with synthetic fiber material, and comprising one or more pairs of polyaramid fiber units, each polyaramid fiber unit formed by braiding dozens to hundreds of fine polyaramid fiber strands to maintain a diameter within 200-600 denier; and a coil spirally wound around an outer portion of the core in predetermined intervals, the coil, formed of copper or copper alloy, is configured to withstand temperature rising up to 60° C. within five minutes in response to an electric power of 3.7-12V to maintain a resistance per unit length value equal to or greater than 0.5 Ω/m.

2. A heating unit utilizing heating wires formed by a core comprising one or more pairs of polyaramid fiber units, each polyaramid fiber unit formed by braiding dozens to hundreds of polyaramid fiber strands to maintain a diameter within 200-600 denier; a coil, formed of copper or copper alloy, spirally wound around an outer portion of the core in predetermined intervals to maintain a resistance per unit length value equal to or greater than 0.5 Ω/m; wherein both sides of the heating wires closely attached to an upper portion of a fabric are fixed by a first fixing wire crossing the heating wires in a zigzag shape by embroidering, the first fixing wire is fixed by a second fixing wire; and an outer cover coupled to upper and lower portions of the fabric.

3. The heating unit of claim 2, further comprising an insulator film configured to release far infrared rays or anions and installed between the heating wires and the outer cover; and wherein the heating wires are configured to receive power from one of a USB connector, a DC power connecting jack, or batteries.

4. The heating unit of claim 2 incorporated in socks.

5. The heating unit of claim 2 incorporated in gloves.

6. The heating unit of claim 2 incorporated in a heating mat.

* * * * *